US006301757B1

(12) United States Patent
Kunii et al.

(10) Patent No.: US 6,301,757 B1
(45) Date of Patent: Oct. 16, 2001

(54) BUCKLE

(75) Inventors: Kazuo Kunii, Fukushima-ken; Tomohisa Ishida, Saitama-ken, both of (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/458,884

(22) Filed: Dec. 10, 1999

(30) Foreign Application Priority Data

Dec. 24, 1998 (JP) ..... 10-367186

(51) Int. Cl.[7] ..... A44B 11/25
(52) U.S. Cl. ..... 24/636; 24/616; 24/647
(58) Field of Search ..... 24/636, 647, 646, 24/650, 616

(56) References Cited

U.S. PATENT DOCUMENTS

| | | | | |
|---|---|---|---|---|
| 1,806,265 | | 5/1931 | Roy . | |
| 1,807,293 | | 5/1931 | Keller . | |
| 4,881,305 | * | 11/1989 | Rivera | 24/616 |
| 4,893,383 | * | 1/1990 | Quickel | 24/647 |
| 4,924,562 | * | 5/1990 | Pogharian | 24/647 |
| 5,435,047 | | 7/1995 | Colpo . | |

FOREIGN PATENT DOCUMENTS

| | | |
|---|---|---|
| 295 05 671 U1 | 4/1995 | (DE) . |
| 814752 | 6/1959 | (GB) . |
| 8-52009 | 2/1996 | (JP) . |

* cited by examiner

*Primary Examiner*—Victor N. Sakran
(74) *Attorney, Agent, or Firm*—Finnegan, Henderson, Farabow, Garrett & Dunner, L.L.P.

(57) ABSTRACT

A buckle comprises a male member and a female member. The male member is provided with an insertion portion adapted to be inserted into the female member and an insertion hole formed inside of the insertion portion. The female member is provided with a recess in which the insertion portion is to be fitted, and an accommodating portion adapted to communicate with the insertion hole. The accommodating portion is provided therein with an engaging piece swingable in an inserting direction to the insertion hole. The engaging piece is provided with an engaging portion which is to be inserted through the insertion hole. The insertion hole of the male member is formed with a locking surface against which the engaging portion is adapted to abut. The accommodating portion is provided with a pair of receiving portions located at opposite sides of the recess for supporting a pair of abutment portions of the engaging portion, and is adapted to be located on opposite sides of the locking surface in an engaged state of the buckle. Therefore, the buckle has a high engaging force between the male member and the female member, and these members can not be disengaged from each other unintentionally even if tensile force is applied to the buckle.

6 Claims, 5 Drawing Sheets

BUCKLE

BACKGROUND OF THE INVENTION

1. Field of the Invention

The present invention relates to a buckle which is an engaging tool used for connecting portions of a belt, a bag band and the like.

2. Description of the Related Art

As disclosed in Japanese Patent Laid-open Publication No. 8-52009, a conventional buckle provided on each of opposite ends of a belt, for example, comprises a male member and a female member. A plate-like insertion portion projects from a base of the male member, and an engaging portion projects from a tip end of one surface of the insertion portion. The female member is provided with an accommodating portion for accommodating the insertion portion and an engaged portion which is formed in the accommodating portion and which is to be engaged with the engaging portion of the male member. The female member is provided with a plate-like resilient pushing portion at its location opposed to the engaged portion.

In operation of the buckle, the insertion portion of the male member is fitted into the accommodating portion of the female member, and the engaging portion is engaged with the engaged portion. At that time, the resilient pushing portion abuts against a back side of the insertion portion to push the insertion portion toward the engaged portion so that the engaging portion of the insertion portion can not be disengaged from the engaged portion.

In the case of the above-described prior art, however, since the engaging portion is provided on one surface of the insertion portion, engagement is in a cantilever state. Therefore, when a strong tensile strength is generated in a direction in which the male member and the female member are separated from each other, the insertion portion is resiliently deformed in a direction opposite from the engaged portion, so that the male member and the female member may be disengaged from each other unintentionally.

SUMMARY OF THE INVENTION

The present invention has been accomplished in view of the conventional problem, and it is an object of the present invention to provide a buckle in which engaging strength between a male member and a female member is large, and the male member and the female member can not be disengaged unintentionally.

According to the present invention, there is provided a buckle comprising a male member adapted to be mounted to one of members which are to be connected to each other, and a female member adapted to be mounted to the other member, wherein the male member is provided with an insertion portion in a form a pair of plates adapted to be inserted into the female member and an insertion hole formed inside of the insertion portion. The female member is provided with a recess in which the insertion portion is adapted to be fitted, and an accommodating portion adapted to communicate with the insertion hole. The accommodating portion is provided therein with an engaging piece swingable in an inserting direction to the insertion hole, and the engaging piece is provided with an engaging portion adapted to be inserted through the insertion hole. The insertion hole of the male member is formed with a locking surface against which the engaging portion is adapted to abut. The locking surface which connects the pair of plates of the insertion portion is integrally formed on an inside face of the insertion hole opposing to a base of the male member. The locking surface is located substantially perpendicular to a direction in which the male member and the female member are separated from each other, and a central imaginary line of the direction in which the male member and the female member are separated from each other is located at a center of the locking surface. The accommodating portion of the female member is provided with at least one receiving portion located at at least one of opposite sides of the recess for supporting at least one abutment portion of the engaging portion. The receiving portion is located at least on one of opposite sides of the locking surface when the engaging portion engages with the locking surface.

A resilient member such as a spring for urging the engaging portion of the engaging piece in a direction in which the engaging portion is inserted into the insertion hole. The resilient member may be a resilient projection or the like formed on at least one of the engaging piece and the female member.

The engaging piece is provided in the accommodating portion such that the engaging piece can be locked in an insertion direction of the insertion hole when the male member and the female member engage with each other.

Further, the engaging piece is formed with an operating portion projecting from one side surface of the engaging piece and adapted to be exposed from the accommodating portion accommodating the engaging piece.

In the buckle of the present invention, the insertion portion of the male member is inserted into the recess of the female member when the male member and the female member are connected to each other. At that time, the insertion hole provided in the insertion portion communicates with the accommodating portion of the female member, the engaging piece in the accommodating portion is swingable, and the engaging portion of the engaging piece is inserted into the insertion portion. With this operation, a locked surface of the engaging piece abuts against the locking surface of the male member, and the at least one abutment portion at one of the opposite sides of the engaging portion is supported and mounted by the at least one portion.

DETAILED DESCRIPTION OF THE PREFERRED EMBODIMENTS

Figure 1:
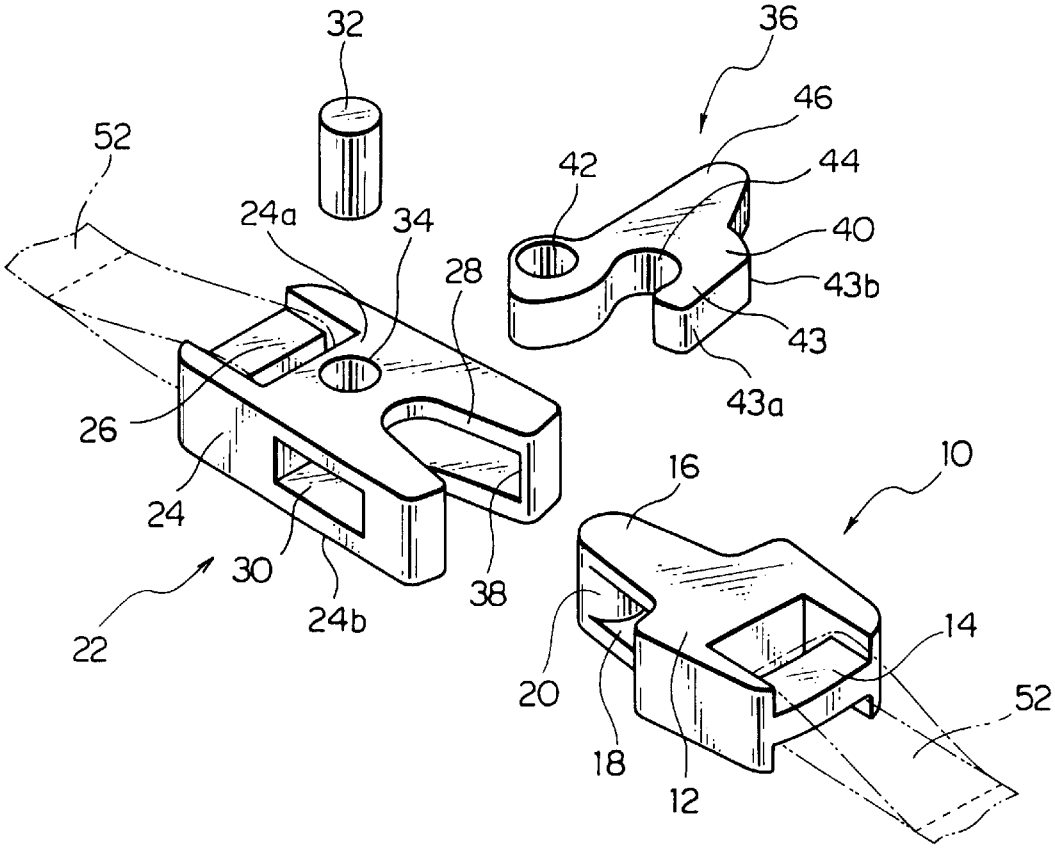
FIG. 1 is an exploded perspective view of a buckle according to a first embodiment of the present invention.
Figure 2:
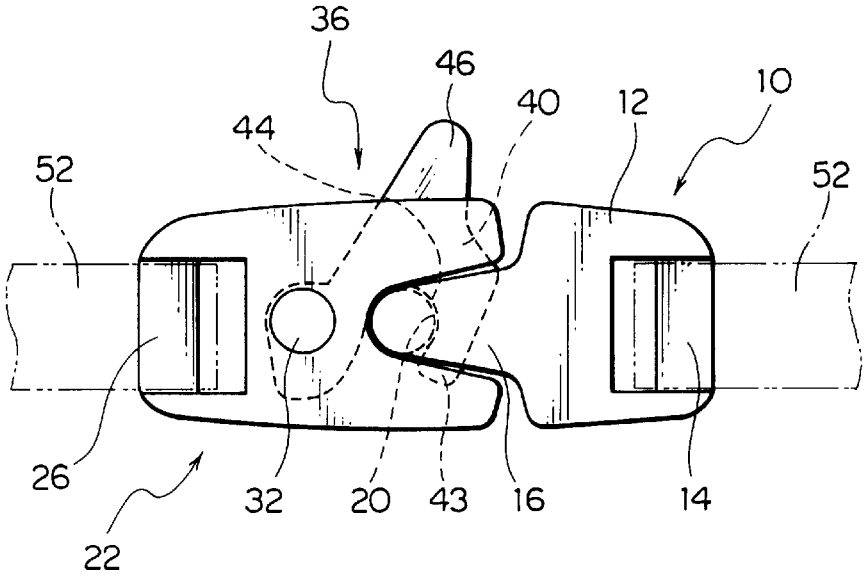
FIG. 2 is a front view of the buckle of the first embodiment.

Embodiments of the present invention will be described based on the accompanying drawings. FIGS. 1 to 6 show a first embodiment of the present invention. A buckle in the first embodiment comprises a resin-made male member 10 to be mounted to one end of a belt 52, and a resin-made female member 22 which is mounted to the other end of the belt 52 or a mounting piece of a member (not shown) and with which the male member 10 is to be inserted and engaged.

The male member 10 has a base 12. The base 12 is provided at its one side surface with a bar-like belt mounting portion 14. An insertion portion 16 in a form of a pair of plates is formed so as to project from a side surface of the base 12 which is opposite from the belt mounting portion 14. The insertion portion 16 is formed with an insertion hole 18 which is in parallel to the belt mounting portion 14. An inner surface of the insertion hole 18 opposite from the base 12 serves as a locking surface 20. The locking surface 20 is formed into a columnar shape which is integrally continuous between tip ends of the pair of plates of the insertion portion 16.

The female member 22 has a base 24. The base 24 is provided at its one surface with a bar-like belt mounting portion 26. The base 24 is formed, at its side surface opposite from the belt mounting portion 26, with a recess 28 in which the insertion portion 16 is to be fitted. An accommodating portion 30 is provided inside of the base 24 so as to pass through the base 24 in parallel to the belt mounting portion 26. The accommodating portion 30 communicates with the recess 28. Through holes 34 are formed in upper and lower surfaces 24*a* and 24*b* in the vicinity of a curved hollow of an inner wall surface of the base 24 near the belt mounting portion 26 in the accommodating portion 30. A shaft member 32 which will be described later is to be inserted through the through holes 34. Inner walls of the accommodating portion 30 of the female member 22 located at opposite sides of the recess 28 are provided with a pair of receiving portions 38, to which an engaging piece 36 which will be described later is to be locked. At least one of the receiving portions 38 is formed with a holding portion 38*a*, and its an abutment portion with the engaging piece 36 is formed into such a shape as being capable of locking.

The columnar shaft member 32 is inserted through the through holes 34 of the female member 22 so that the engaging piece 36 can swing around the shaft member 32. The engaging piece 36 includes a substantially U-shaped body 40. One end of the body 40 is formed with a through hole 42 through which the shaft member 32 is inserted. The other end of the body 40 is formed as an engaging portion 43 for engaging with the male member 10. A U-shaped inner side surface of the body 40 is formed as a cylindrical locked surface 44 which is to be combined with the locking surface 20 of the male member 10. A curved outer side surface of the body 40 is formed with an operating portion 46 projecting sideways. The outer side surface of the body 40 in the vicinity of the through hole 42 is formed with a recess 48. One end of a compressed spring 50 is mounted to the recess 48, and the other end of the spring 50 is mounted to an inner side surface of the accommodating portion 30 facing to the recess 48. The spring 50 urges the engaging piece 36 rightward about the shaft member 32 as viewed FIG. 5.

The engaging piece 36 is inserted in the accommodating portion 30 of the female member 22. A tip end and a base end of a curved portion of the outer side surface of the engaging portion 43 are formed as abutment portions 43*a* and 43*b*, respectively. The operating portion 46 of the engaging piece 36 projects outward from an opening of the accommodating portion 30 of the female member 22. Wide belts 52 are respectively mounted to the belt mounting portion 14 of the male member 10 and the belt mounting portion 26 of the female member 22.

Figure 5:
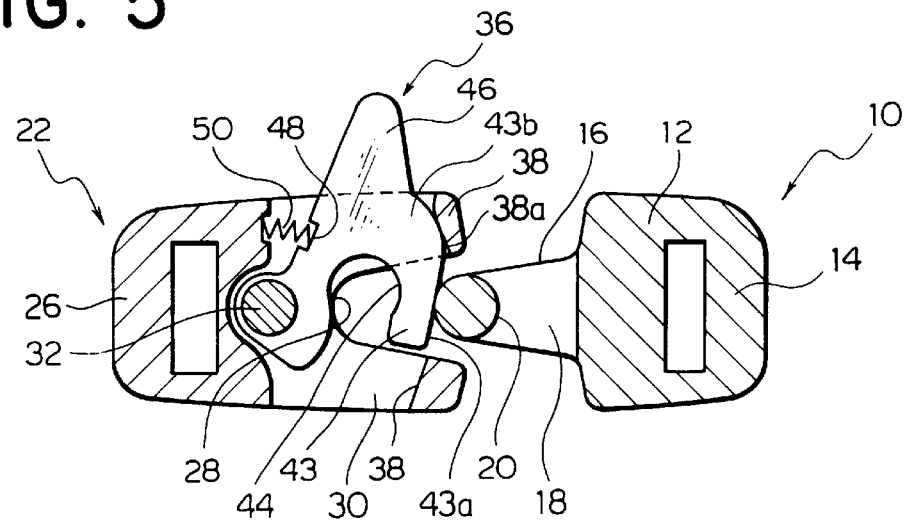
FIG. 5 is a vertical sectional view showing a state before a male member and a female member of the buckle of the first embodiment are engaged with each other.
Figure 6:
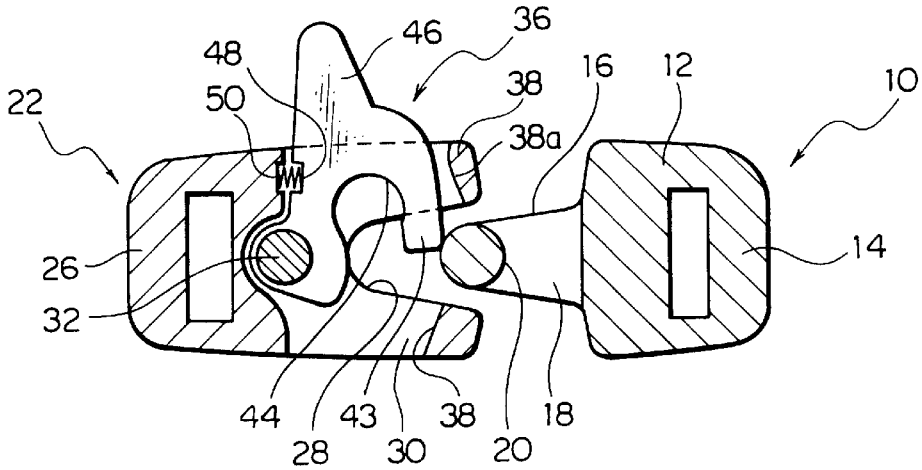
FIG. 6 is a vertical sectional view showing an engaging operation between the male member and the female member of the buckle according to the first embodiment.
Figure 7:
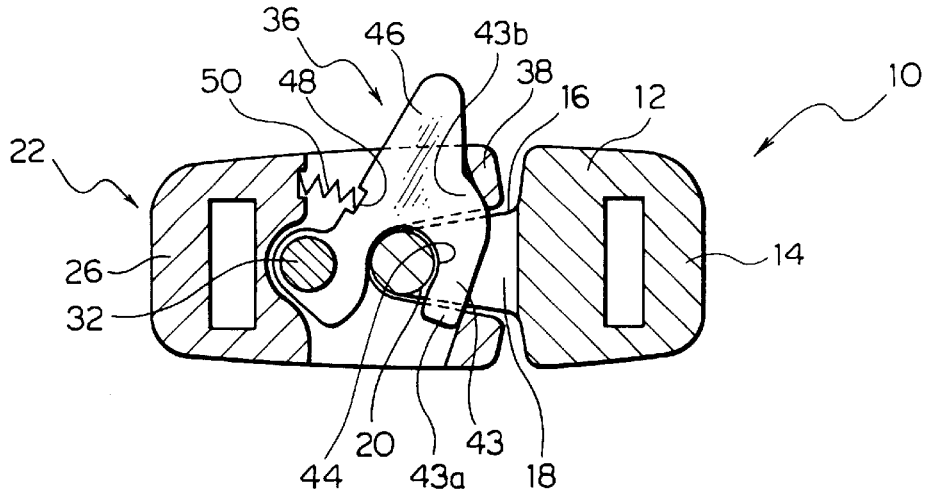
FIG. 7 is a vertical sectional view showing a state of the male member and the female member of the buckle of the first embodiment being engaged with each other.

The operation of the buckle of this embodiment will be explained based on FIGS. 5 to 7. First, when the male member 10 is separated from the female member 22 as shown in FIG. 5, the engaging piece 36 is located on the right side in FIG. 5 by the compressed spring 50, and the outer side surface of the curved portion of the engaging piece 36 abuts against an inner wall surface of the accommodating portion 30 of the female member 22 and is locked. At that time, the operating portion 46 of the engaging piece 36 is located on the right side in FIG. 5, and the engaging portion 43 of the engaging piece 36 is located inside of the recess 28 of the female member 22. To mount the male member 10 to the female member 22, the operating portion 46 of the engaging piece 36 is manually moved toward the belt mounting portion 26 of the female member 22 as shown in FIG. 6. With this operation, the engaging piece 36 swings about the shaft member 32 in a counterclockwise direction in FIG. 6, and the spring 50 is compressed, so that the recess 28 of the female member 22 is opened. Next, when the insertion portion 16 of the male member 10 is fitted into the recess 28 of the female member 22 and the operating portion 46 is released, the engaging piece 36 swings rightward about the shaft member 32 by the compressed spring 50 as shown in FIG. 7. The operating portion 46 may be manually further moved rightward if necessary. With this operation, the engaging portion 43 of the engaging piece 36 is inserted into the insertion hole 18 of the male member 10, so that the locking surface 20 of the male member 10 abuts against the locked surface 44 of the engaging piece 36, thus the male member 10 and the female member 22 are coupled to each other. At that time, the abutment portions 43*a* and 43*b* of the outer side surface of the body 40 of the engaging piece 36 extending from the curved portion to the engaging portion 43 are stably locked to the receiving portions 38 of the female member 22. Further, a curved surface extending from the curved portion of the body 40 to the engaging portion 43 abuts against the holding portion 38*a* of the receiving portion 38 so as to prevent the engaging piece 36 from turning in a counterclockwise direction as viewed in FIG. 7.

To release the engagement between the female member 22 and the male member 10, the operating portion 46 of the engaging piece 36 is moved toward the belt mounting portion 26 of the female member 22 against the urging force of the spring 50 as shown in FIG. 6 to swing the engaging piece 36, thereby releasing the engagement.

If the tip end of the male member 10 abuts against the engaging portion 43 of the engaging piece 36 and is strongly pushed, since the engaging piece 43 is positioned obliquely with respect to the insertion direction of the male member 10 as shown in FIG. 5, a force in the counterclockwise direction is applied to the engaging piece 36 as viewed in FIG. 5. With this force, the engaging portion 43 of the engaging piece 36 is turned as shown in FIG. 6, and the male member 10 may be capable of inserting into the recess 28 of the female member 22.

Figure 3:
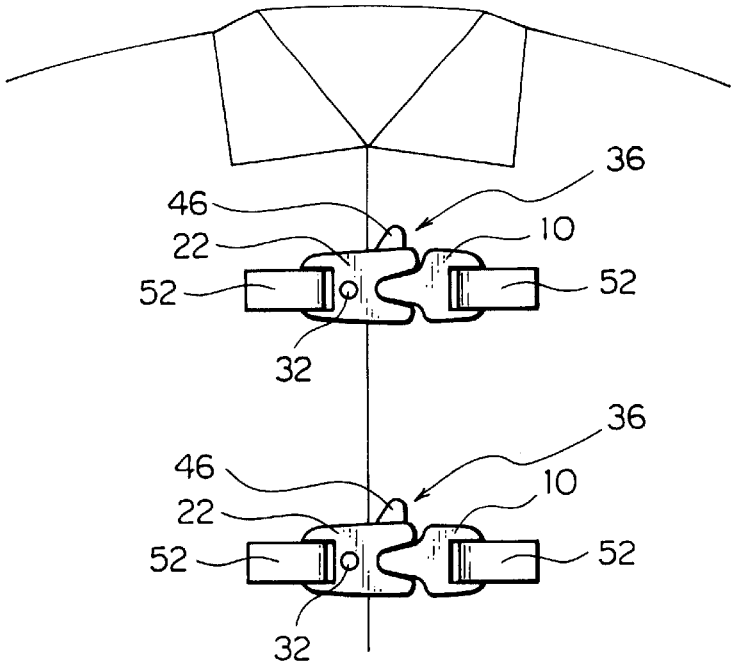
FIG. 3 is a front view showing a state of the buckle of the first embodiment being used.
Figure 4:
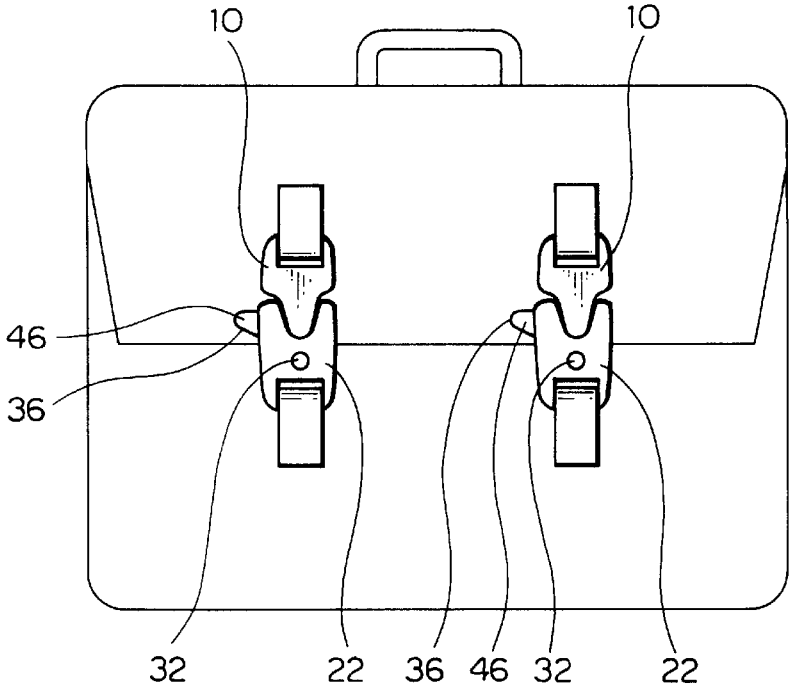
FIG. 4 is a front view showing another state of the buckle of the first embodiment being used.

When the buckle of this embodiment is used, the male member 10 is mounted to one end of the belt 52, the female member 22 is mounted to the other end of the belt 52. Then, the belt 52 is wound around, for example, a body of an article to hold it, so that the male member 10 and the female member 22 are mounted in an annular form. Besides it, the buckle can be freely used, for example, for closing openings of clothing as shown in FIG. 3, or for locking a lid of a bag to its body as shown in FIG. 4. Further, the buckle may be used for connecting opposite ends of a chain of a tire.

According to the buckle of this embodiment, the locked surface 44 of the engaging piece 36 and the locking surface 20 of the male member 10 abut against each other over a wide area, and the locked surface 44 and the locking surface 20 are located at a center of a force in a direction in which the male member 10 and the female member 22 are separated from each other. Further, the force applied to the locking surface 20 of the male member 10 and the locked surface 44 of the engaging piece 36 is equally applied to the receiving portions 38 of the female member 22 by the abutment portions 43*a* and 43*b* of the locking portion 43, so that the locking surface 20 and the locked surface 44 are stably and reliably held. Therefore, even when the force acts in a direction in which the male member 10 and the female member 22 are separated from each other, the engagement is not easily released, and a reliable mounting state can be obtained.

Since the buckle of this embodiment is strong against the tensile force, it can be used at a portion where a strong force is applied, and it is possible to reliably connect a chain of a tire.

Figure 8:
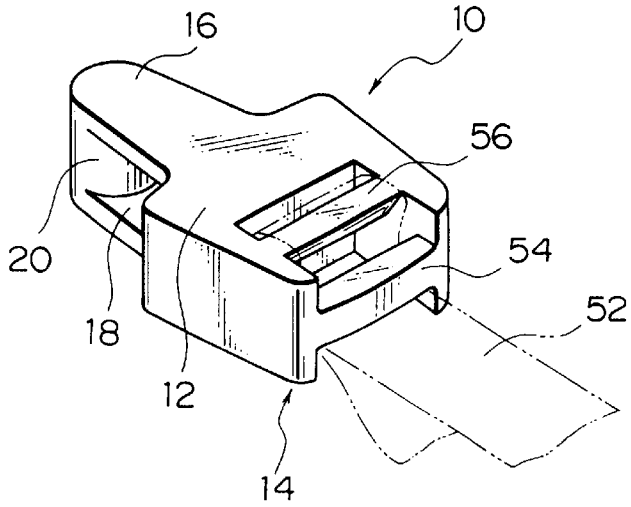
FIG. 8 is a perspective view showing a modification of the male member of the buckle of the first embodiment.

In the buckle of this embodiment, the belt mounting portion 14 may be shaped such t h at a bar-like belt-insertion portion 54 and an adjusting ring 56 are provided perpendicular to the insertion direction of the belt 52, and are located at different heights with respect to a surface of the belt 52 as shown in FIG. 8. Such a belt mounting portion 14 may be provided on the female member 22 also. In the case of this belt mounting portion 14, it is unnecessary to sew the folded and superposed portions of the belt 52, and the length of the belt can freely be adjusted.

Figure 9:
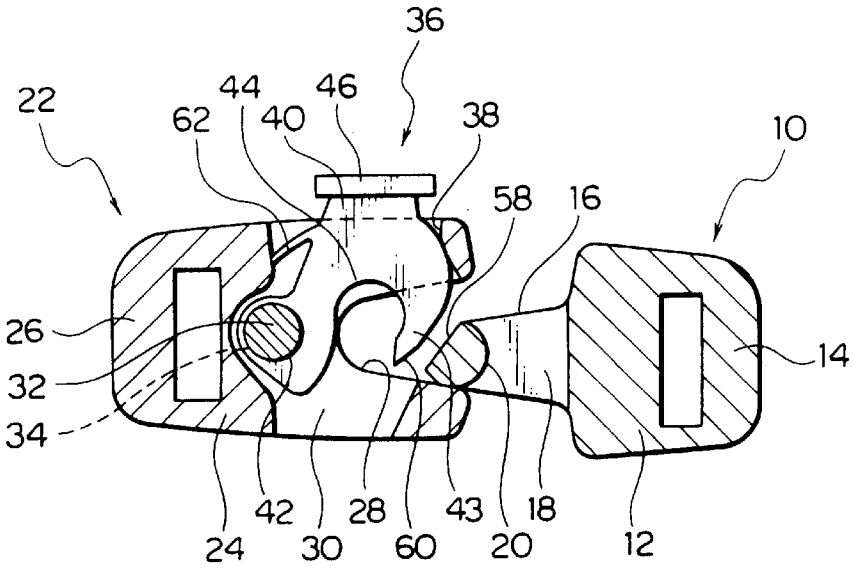
FIG. 9 is a vertical sectional view of a buckle according to a second embodiment of the invention.

Next, a second embodiment of the present invention will be explained based on FIG. 9. Members similar to those in the first embodiment are designated by the same reference numbers, and their descriptions will be omitted. In the buckle of the second embodiment, a male member 10 is provided at its one side surface with a bar-like belt mounting portion 14, and a insertion portion 16 is integrally formed so as to project from a side surface of a base 12 of the male member 10 opposite from the belt mounting portion 14. A tip end of the insertion portion 16 is provided with a slant 58 which is formed obliquely with respect to a projecting direction of the insertion portion 16. The insertion portion 16 is formed with an insertion hole 18 parallel to the belt mounting portion 14. An inner surface of the insertion hole 18 facing to the base 12 serves as the locking surface 20. The locking surface 20 is formed into a semicircular shape which is continuous with a tip end surface of the insertion portions 16.

The female member 22 is provided, at a side surface of a base 24 thereof, with a bar-like belt mounting portion 26. The recess 28 into which the insertion portion 16 is fitted is formed in a side surface of the base 24 opposite from the belt mounting portion 26. A accommodating portion 3 is formed so as to pass through the base 24 in parallel to the belt mounting portion 26. A through hole 34 which communicates with the accommodating portion 30 is formed in a n upper surface of the base 24. One of inner walls of the accommodating portion 30 located at opposite sides of the recess 28 is provided with a receiving portion 38 to which an engaging piece 36 is locked.

A columnar shaft member 32 is inserted through the through hole 34 of the female member 22 so that the engaging piece 36 can swing about the shaft member 32. The engaging piece 36 includes a substantially U-shaped body 40. One end of the body 40 is formed with a through hole 42 through which the shaft member 32 is inserted. The other end of the body 40 is formed as an engaging portion 43 for engaging with the male member 10. An outer side surface of the engaging portion 43 is formed with a pushing surface 60 which is to face to a slant 58 of the male member 10. A tip end of the pushing surface 60 is slightly inclined in a direction approaching the base 24 of the female member 22. The U-shaped inner side surface of the body 40 is formed with a cylindrical locked surface 44 which is to be fitted to the locking surface of the male member 10. An outer side surface of the curved portion of the body 40 is provided with an operating portion 46 which is in a form of a projection parallel to the outer side surface. A resilient projection 62 which projects sideways at a predetermined angle is integrally provided between the operating portion 46 and the through hole 42.

The engaging piece 36 is received in the accommodating portion 30 of the female member 22. The operating portion 46 of the engaging piece 36 at that time projects outward from an opening of the accommodating portion 30 of the female member 22. The resilient projection 62 of the engaging piece 36 abuts against an inner wall surface of the accommodating portion 30 of the female member 22 so as to urge the engaging piece 36 in a clockwise direction about the shaft member 32 as viewed in FIG. 9.

Next, the operation of the buckle of this second embodiment will be explained. First, when the male member 10 is separated from the female member 22 as shown in FIG. 9, the engaging piece 36 is located on the right side in FIG. 9 by the resilient projection 62, and an outer side surface of the curved portion of the engaging piece 36 abuts against the inner wall surface of the accommodating portion 30 of the female member 22 and is locked. At that time, the operating portion 46 of the engaging piece 36 is also located on the right side in FIG. 9, and the engaging portion 43 of the engaging piece 36 is located inside of the recess 28 of the female member 22. To mount the male member 10 to the female member 22, the insertion portion 16 of the male member 10 is inserted into the recess 28 of the female member 22, the slant 58 of the insertion portion 16 is allowed to abut against the pushing surface 60 of the engaging piece 36 to push the pushing surface 60. When the male member 10 is further inserted, the resilient projection 62 of the engaging piece 36 is resiliently deformed so that the engaging piece 36 swing about the shaft member 32 in the counterclockwise direction as viewed in FIG. 9. After the engaging portion 43 of the engaging piece 36 climbs over the slant 58 of the male member 10, the engaging piece 36 swings about the shaft member 32 by the resilient projection 62 in the clockwise direction, and the operating portion 46 moves rightward as viewed in FIG. 9. Then, the engaging portion 43 of the engaging piece 36 is inserted into the through hole 18 of the male member 10, the locking surface 20 of the male member 10 and the locked surface 44 of the engaging piece 36 abut against each other. Thus, the coupling of the male member 10 and the female member 22 is completed.

To release the engagement between the female member 22 and the male member 10, the operating portion 46 of the engaging piece 36 is moved to rotate the engaging piece 36 in the counterclockwise direction, thereby releasing the engagement.

The buckle of the present embodiment can be used in the same manner as that of the first embodiment, and the same effects can be obtained. Further, the female member 22 and the male member 10 can be automatically coupled to each other only by pushing the pushing surface 60 of the engaging piece 36 by the insertion portion 16 of the male member 10, which is easy and convenient.

Figure 10:
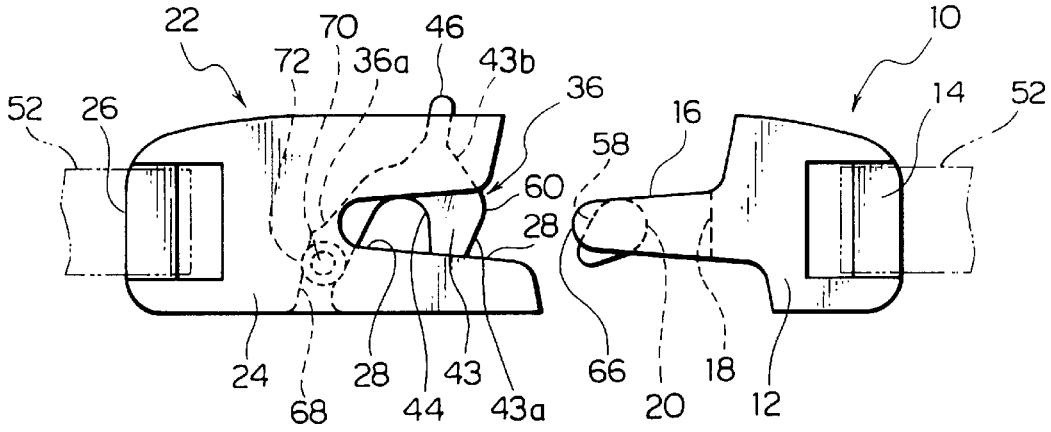
FIG. 10 is a front view of a buckle according to a third embodiment of the invention.
Figure 11:
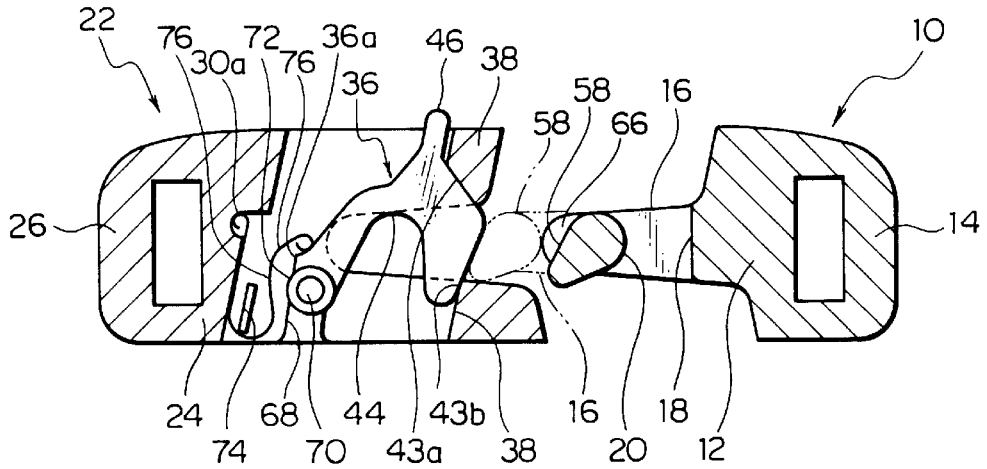
FIG. 11 is a vertical sectional view of a buckle of the third embodiment before being engaged.
Figure 12:
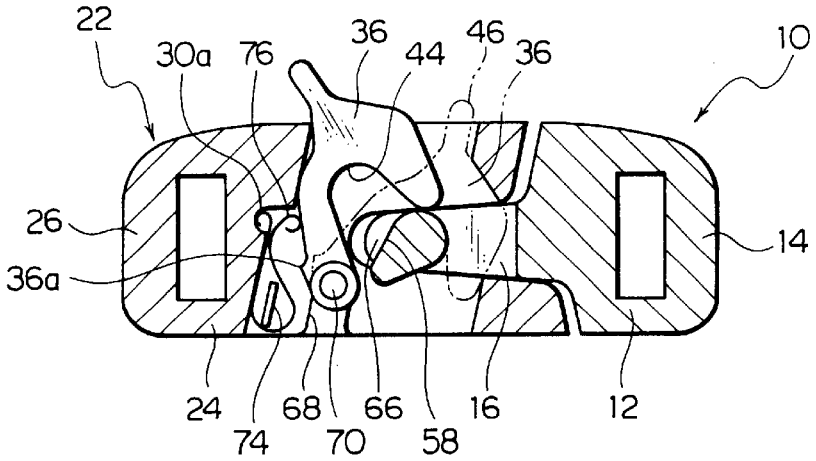
FIG. 12 is a vertical sectional view of a state of the buckle of the third embodiment being engaged.

Next, a third embodiment of the present invention will be explained based on FIGS. 10 to 12. Members similar to those in the first embodiment are designated by the same reference numbers, and their descriptions will be omitted. In the buckle of the third embodiment, a male member 10 is provided at its one side surface with a bar-like belt mounting portion 14, and an insertion portions 16 integrally projecting from a side surface of the male member 10 opposite from the belt mounting portion 14. A tip end of the insertion portion 16 is formed with a bifurcated projection 66, and a base end of the insertion portion 16 is formed with an insertion hole 18. Between the bifurcated projection 66 and the insertion hole 18, a slant 58 is formed on a bottom portion between tip ends of the bifurcated projection 66. A portion of the projection 66 opposite from the slant 58 and facing to the insertion hole 18 is formed as a locking surface 20. The slant 58 slightly projects sideways of the projection 66 of the insertion portion 16 so that a wider area can be secured for the slant 58.

One side surface of a base 24 of the female member 22 is provided with a belt mounting portion 26. A side surface of the base 24 opposite from the belt mounting portion 26 is formed with a recess 28 in which the insertion portion 16 is to be fitted. A accommodating portion 30 is formed so as to pass through the base 24 in parallel to the belt mounting portion 26. One of opposite openings of the accommodating portion 30 has, at its opposite inner side surfaces, grooved shaft guide portions 68. Tip ends of the shaft guide portions 68 are formed with a pair of shaft mounting portions 72 for supporting a shaft portion 70 of an engaging piece 36.

The engaging piece 36 of this embodiment is formed into a substantially U-shape, and is formed with a pushing surface 60 which is to face to the slant 58 of the male member 10 and which has a tip end slightly inclining in a direction approaching the base 24 of the female member 22.

A leaf spring 76 as a resilient member is provided between the engaging piece 36 and one end surface of the accommodating portion 30. The leaf spring 76 urges the engaging piece 36 to swing the engaging piece 36 in the clockwise direction as viewed in FIG. 11. The leaf spring 76 is positioned by a spring supporting portion 74 which projects in the accommodating portion 30 of the female member 22. One end of the leaf spring 76 engages in a recess 30a of the accommodating portion 30, and the other end resiliently abuts against the engaging piece 36.

To insert the engaging piece 36 of this third embodiment into the accommodating portion 30 of the female member 22, the shaft portion 70 of the engaging piece 36 is slid along the shaft guide portions 68 of the accommodating portion 30, and the engaging piece 36 is held with the shaft portion 70 being fitted in the shaft mounting portion 72. The leaf spring 76 is allowed to abut against the spring supporting portion 74, and its one end of the leaf spring 76 engages in the recess 30*a* and the other end abuts against a step portion 36*a* of the engaging piece 36.

Next, the operation of the buckle of this embodiment will be explained. First, when the male member 10 is separated from the female member 22, the engaging piece 36 is located on the right side by the leaf spring 76 as shown in FIGS. 10 and 11, and the abutment portions 43*a* and 43*b* of the curved portions of the engaging piece 36 abut against the receiving portions 38 of an inner wall surface of the accommodating portion 30 of the female member 22 and is locked. To mount the male member 10 to the female member 22, the slant 58 of the insertion portion 16 is allowed to abut against the pushing surface 60 of the engaging piece 36 to push the engaging piece 36. If the male member 10 is further inserted, the leaf spring 76 is resiliently deformed, and the engaging piece 36 swings about the shaft portion 70 in the counterclockwise direction as viewed in FIG. 11. Thereafter, as shown in FIG. 12, when the engaging portion 43 of the engaging piece 36 climbs over the slant 58 of the male member 10, the engaging piece 36 swings about the shaft portion 70 in the clockwise direction by the urging force of the leaf spring 76, so that the operating portion 46 moves rightward. Then, the engaging portion 43 of the engaging piece 36 is inserted into the insertion hole 18 of the male member 10, the locking surface 20 of the male member 10 and the locked surface 44 of the engaging piece 36 abut against each other, and the abutment portions 43*a* and 43*b* of the engaging piece 36 abuts against the receiving portions 38 of the female member 22, respectively. Thereafter, the female member 22 and the male member 10 are supported at two points, and are engaged with each other reliably.

To release the engagement between the female member 22 and the male member 10, the operating portion 46 of the engaging piece 36 is moved to rotate the engaging piece 36 in the counterclockwise direction.

The buckle of this embodiment can be used in the same manner as that of the previous embodiment, and the same effects can be obtained. Especially, two-point support is reliably achieved by the abutment portion 43*a* and 43*b*, so that it is possible to realize a strong engagement.

The buckle of the present invention should not be limited to each of the above embodiments, shapes of the insertion portion 16 of the male member 10 and the recess 28 of the female member 22 can freely be changed as far as they can be fitted to each other. The locking surface 20 of the insertion portion 16 and the locked surface 44 of the engaging piece 36, as well as the engaging piece 36 and the receiving portions 38 of the female member 22 may be changed only if they can be combined with each other and can receive force in a direction in which the male member 10 and the female member 22 are separated from each other, substantially equally at opposite sides with the two-point supporting structure.

According to the buckle of the present invention, since the male member 10 and the female member 22 are engaged with each other in such a manner that the locked surface 44 of the engaging piece 36 inside of the female member 22 abuts against the locking surface 20 of the male member 10, their engaging state can reliably be maintained. Further, since the locking surface 20 of the male member 10 and the engaging piece 36 abut against each other over a wide area, and receive the force in a direction in which the male member 10 and the female member 22 are separated from each other, substantially equally at the opposite sides, the engaging strength is extremely high, and the engaging state can strongly be maintained against the tensile force.

Further, since the engaging piece 36 is urged in the engaging direction by the resilient member 50, 62, 76, the engaging state can be maintained more stably, and the possibility of engagement failure is lowered. Furthermore, when the resilient member 50, 62 and the engaging piece 36 are integrally formed, the manufacturing process is facilitated, and costs are reduced.

What is claimed is:

1. A buckle including a male member adapted to be mounted to one of members which are to be connected to each other, and a female member adapted to be mounted to the other member, wherein said male member is provided with an insertion portion adapted to be inserted into said female member and an insertion hole formed inside of said insertion portion, said female member is provided with a recess in which said insertion portion is adapted to be fitted, and an accommodating portion adapted to communicate with said insertion hole, said accommodating portion is provided therein with an engaging piece swingable in an inserting direction to said insertion hole, said engaging piece being provided with an engaging portion adapted to be inserted through said insertion hole, said insertion hole of said male member is formed with a locking surface against which said engaging portion is adapted to abut, and said accommodating portion of said female member is provided with at least one receiving portion located at at least one of opposite sides of said recess for supporting at least one abutment portion of said engaging portion, said receiving portion being adapted to be located on at least one of opposite sides of said locking surface when said engaging portion engages with said locking surface.

2. A buckle according to claim 1, wherein when said engaging portion engages with said locking surface, a pair of said abutment portions of said engaging portion located on opposite sides of said locking surface are provided such that said abutment portions abut against a pair of said receiving portions which support said abutment portions.

3. A buckle according to claim 1 or 2, wherein said locking surface is located substantially perpendicular to a direction in which said male member and said female member are separated from each other, a central imaginary line in the direction In which said male member and said female member are separated from each other is located at a center of said locking surface.

4. A buckle according to claim 1 or 2, further including a resilient member provided between said engaging piece and said female member for urging said engaging portion of said engaging piece in a direction in which said engaging portion is inserted into said insertion hole.

5. A buckle according to any one of claims 1, wherein said receiving portion in said accommodating portion locks said engaging piece at a predetermined position.

6. A buckle according to any one of claims 1, wherein said engaging piece is formed with an operating portion which projects from one side surface of said engaging piece and is adapted to be exposed from said accommodating portion.

* * * * *